US010959008B2

(12) United States Patent
El Guindi et al.

(10) Patent No.: US 10,959,008 B2
(45) Date of Patent: Mar. 23, 2021

(54) ADAPTIVE TAPPING FOR HEARING DEVICES

(71) Applicant: Sonova AG, Staefa (CH)

(72) Inventors: Nadim El Guindi, Zurich (CH); Nina Stumpf, Männedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/368,880

(22) Filed: Mar. 29, 2019

(65) Prior Publication Data

US 2020/0314523 A1 Oct. 1, 2020

Related U.S. Application Data

(63) Continuation of application No. 16/367,328, filed on Mar. 28, 2019.

(51) Int. Cl.
*H04R 1/10* (2006.01)

(52) U.S. Cl.
CPC ..... *H04R 1/1041* (2013.01); *H04R 2420/07* (2013.01)

(58) Field of Classification Search
CPC ..... H04R 1/1016; H04R 2420/07; H04R 2430/01; H04R 1/1058; H04R 1/1091; H04R 2201/029; H04R 2201/107; H04R 2225/31; H04R 2460/13; H04R 2499/11; H04R 25/305; H04R 25/405; H04R 25/505; H04R 25/65; H04R 3/005; H04R 5/033; H04R 5/0335; H04S 7/301; H04S 7/302; H04S 7/305; H04S 7/303; H04Q 2209/823; H04Q 9/00; H04Q 9/04; H04L 12/1827; H04L 27/04; H04L 63/08; H04L 67/22; H04L 67/306; H04L 67/38; H04W 12/06; H04W 12/08; H04W 48/08; H04W 4/025; H04W 4/38; H04W 4/70; H04W 76/10
USPC ..... 381/74, 312, 56–58; 700/94
See application file for complete search history.

(56) References Cited

U.S. PATENT DOCUMENTS

| | | | | |
|---|---|---|---|---|
| 5,636,285 | A | 6/1997 | Sauer | |
| 7,483,832 | B2 | 1/2009 | Tischer | |
| 9,940,928 | B2 | 4/2018 | Haubrich et al. | |
| 10,291,975 | B2 * | 5/2019 | Howell | H04R 1/1016 |
| 10,638,214 | B1 * | 4/2020 | Delhoume | G06F 3/165 |
| 2011/0238419 | A1 | 9/2011 | Barthel | |
| 2012/0135687 | A1 * | 5/2012 | Thorn | H04M 1/7253 455/41.2 |

(Continued)

*Primary Examiner* — Lun-See Lao

(57) ABSTRACT

The disclosed technology generally relates to adaptive tap control for a hearing device. In some implementations, the disclosed technology includes a hearing device configured to detect tapping of the hearing device based on learned tapping parameters. To learn an individual's tapping parameters for a hearing device, the disclosed technology can use a method that includes providing a tap task to a hearing device user; detecting a single tap or multiple taps in response to providing the tap task to the hearing device user; determining tap detection parameters associated with the single or multiple taps; and providing adjusted tap detection parameters for the hearing device based on the determined tap parameters. The hearing device can use the adjusted tap detection parameters to control the hearing device or perform operations by tap control.

15 Claims, 4 Drawing Sheets

(56) References Cited

U.S. PATENT DOCUMENTS

| | | | | |
|---|---|---|---|---|
| 2012/0299950 | A1* | 11/2012 | Ali | G02B 27/0176 345/592 |
| 2013/0322708 | A1* | 12/2013 | Heringslack | G06K 9/00268 382/118 |
| 2014/0111415 | A1* | 4/2014 | Gargi | G06F 3/017 345/156 |
| 2019/0297408 | A1* | 9/2019 | Mohammadi | H04R 1/1041 |

* cited by examiner

ADAPTIVE TAPPING FOR HEARING DEVICES

CROSS-RELATED APPLICATION

The application claims priority to U.S. patent application Ser. No. 16/367,328, titled "Context Dependent Tapping for Hearing Devices," which was filed Mar. 28, 2019, all of which is incorporated by reference herein for its entirety.

TECHNICAL FIELD

The disclosed technology generally relates to a hearing device configured to implement adaptive tap control.

BACKGROUND

To improve everyday user satisfaction with hearing devices, a hearing device user desires a simple means to adjust hearing device parameters. Currently, users can toggle buttons or turn dials on the hearing device to adjust parameters. For example, a user can toggle a button to increase the volume of a hearing device.

However, button or dial technologies have drawbacks. When a user toggles a button or dial, the hearing device user generally needs good dexterity to find the button to push, pull, or spin appropriately. This can be difficult for users with limited dexterity or it can be cumbersome to perform because a user may have difficulty seeing the location of these buttons (especially for elderly individuals). Additionally, a button generally can provide only one or two inputs (e.g., push or release), which limits the number of inputs a user can perform.

Accordingly, there exists a need to provide technology that allows a user to easily adjust the parameters of a hearing device and provide additional benefits.

SUMMARY

This summary is provided to introduce a selection of concepts in a simplified form that are further described below in the Detailed Description. This summary is not intended to identify key features of the claimed subject matter.

The disclosed technology includes a method for adaptive tap control. The method can comprise: providing a tap task to a hearing device user; receiving a single tap or multiple taps in response to providing the tap task to the hearing device user; determining a tap parameter associated with the received single or multiple taps; and providing a tap detection parameter for the hearing device based on the determined tap parameter, wherein the tap detection parameter is used to adjust detection of a hearing device user tapping gesture. In some implementations, a hearing device provides the tap task, a fitting station provides the tap task, or a mobile device provides the tap task. A hearing care professional can also use a computing device to communicate with the hearing device to observe and modify the tap tasks.

The disclosed technology also includes a hearing device that can implement the adaptive tap control method. The hearing device can include a microphone, an accelerometer configured to detect a change in acceleration of the hearing device, a processor configured to perform an operation or operations, and a memory storing the operation or operations. The operations can include part or all the adaptive tap control method.

The disclosed technology also includes a non-transitory computer-readable medium storing instructions that when executed by a processor cause a hearing device to perform operations and the operations can comprise the adaptive tap control method.

In some implementations, the disclosed technology also includes learning from the user by repeated tap tasks. The disclosed technology can include asking if the hearing device user is satisfied with the tap control based on adjusted settings (e.g., via a mobile device user interface or survey). If the user is not satisfied, the disclosed technology repeats the tap task or continues to modify the tap detection parameters until the user is satisfied with the tap control.

Figure 1:
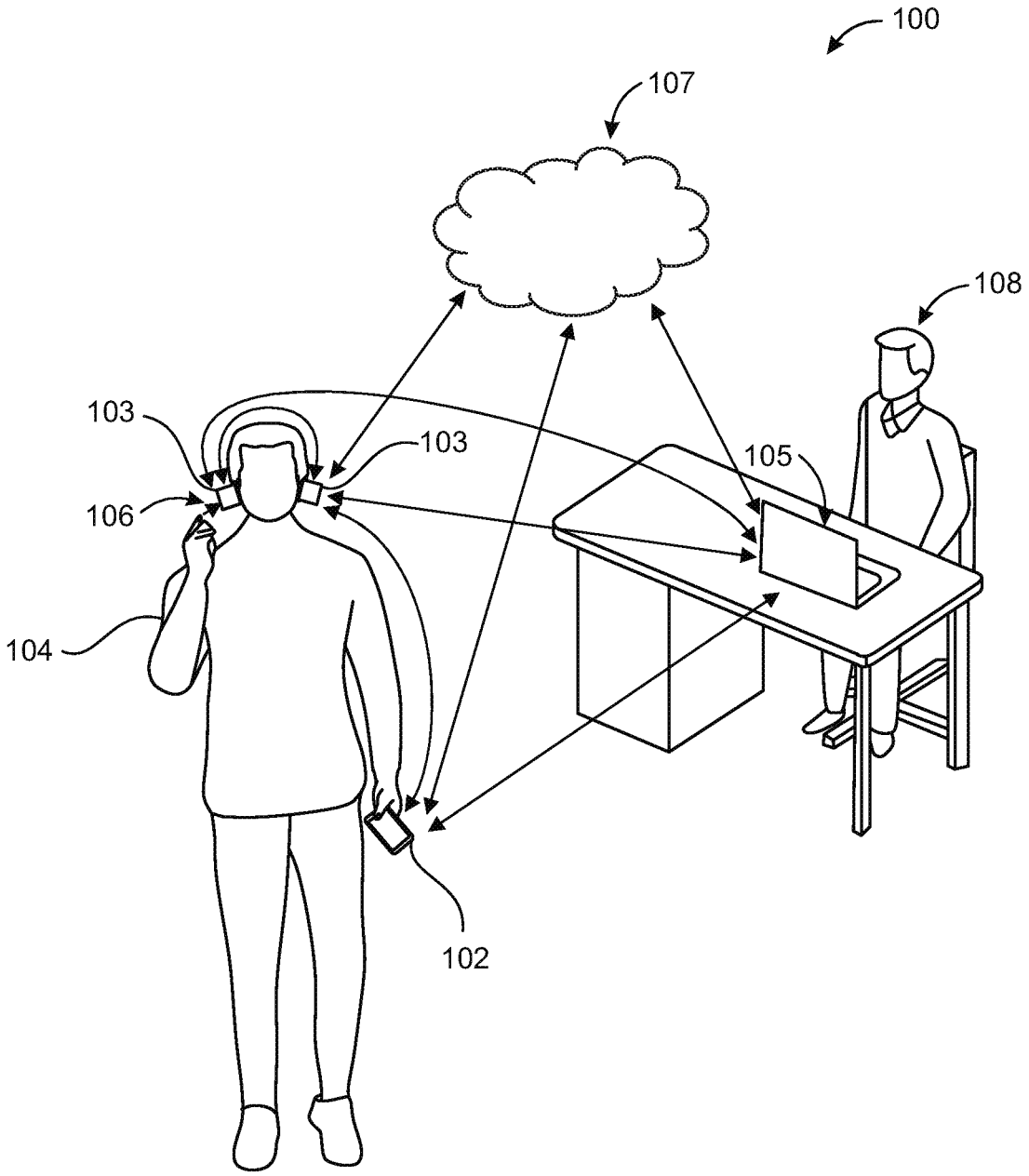
FIG. 1 illustrates a communication environment where a hearing device user can tap a hearing device in accordance with some implementations of the disclosed technology.

The drawings are not to scale. Some components or operations may be separated into different blocks or combined into a single block for the purposes of discussion of some of the disclosed technology. Moreover, while the technology is amenable to various modifications and alternative forms, specific implementations have been shown by way of example in the drawings and are described in detail below. The intention, however, is not to limit the technology to the selected implementations described. On the contrary, the technology is intended to cover all modifications, equivalents, and alternatives falling within the scope of the technology as defined by the appended claims.

DETAILED DESCRIPTION

To enable users to adjust hearing device parameters, hearing devices can have an accelerometer and use it to implement tap control. Tap control generally refers to a hearing device user tapping on the hearing device, tapping on the ear with the hearing device, or tapping on their head a single or multiple times to control the hearing device. Tapping includes touching a hearing device a single or multiple times with a body part or object (e.g., pen).

In some implementations, a tap detection algorithm is implemented in an accelerometer of the hearing device (e.g., in the accelerometer chip). In other implementations, a processor in the hearing device can receive information from the accelerometer, and the processor can implement a tap detection algorithm based on the received information from the accelerometer (e.g., raw data or signals from the accelerometer). Also, in some implementations, the accelerometer and the processor can implement different parts of the tap detection algorithm (separately or in a combined manner).

Based on a detected single tap or double tap, the hearing device can modify a parameter of the hearing device or perform an operation. For example, a single tap or a double tap can cause the hearing device to adjust volume, switch or modify a hearing device program, accept/reject a phone call, start and stop music, or implement active voice control (e.g., voice commands).

However, it is difficult to reliably detect a tap. Reliably detecting a tap means reducing false positives (detected and unwanted taps or vibrations due to handling or movement of the hearing device or other body movements) and false negatives (the user tapped or double tapped but it was not detected) such that a user is satisfied with tap control performance. Further, because hearing devices have different properties (e.g., hearing device form factor, size, shape, location on the ear or location of accelerometer within the hearing device) that can affect tap or vibration properties, a "one size fits all" configuration for tap control may be suboptimal for users. Further, hearing device users vary in how they tap a hearing device, which can make detecting a single tap or double tap based on a standard or set acceleration difficult. For example, some hearing device users tap softly and some tap strongly. Some hearing device users tap slowly or quickly between double taps.

Even more, some hearing device users wear glasses and some hearing device users do not wear glasses, which can change an acceleration signal detected with an accelerometer of a hearing device. Specifically, acceleration signals of different tapping patterns (tap and double tap) for users with and without glasses can be a bit different and therefore optimal parameterization of a tap detector may be different for someone wearing glasses versus not wearing glasses.

To improve tap detection that can be used for tap control, the disclosed technology includes a hearing device configured to detect tapping of the hearing device based on learned or adapted tapping parameters. To learn an individual's tapping parameters for a hearing device, the disclosed technology can implement a method that includes: providing a tap task to a hearing device user; detecting a single tap or multiple taps in response to providing the tap task to the hearing device user; determining tap parameters associated with the single or multiple taps; and providing adjusted tap detection parameters for the hearing device based on the determined tap parameters. The hearing device can use the adjusted tap detection parameters to control the hearing device or perform operations.

The disclosed technology can have a technical benefit or address a technical problem for hearing device tap detection or tap control. The hearing device can use customized tap detection parameters that are learned from a hearing device user so that a tap or double tap is more likely to be accurately detected compared to using a standard tap detection. Additionally, the disclosed technology reduces false detection of taps because it sets the parameters to customized settings that are more likely to detect a tap based on training. Also, the disclosed technology can request feedback from a user, and use that feedback to improve tap control for the hearing devices.

FIG. 1 illustrates a communication environment 100. The communication environment 100 includes wireless communication devices 102 (singular "wireless communication device 102" and multiple "wireless communication devices 102") and hearing devices 103 (singular "hearing device 103" or multiple "hearing devices 103").

A hearing device user can tap the hearing devices 103 a single or multiple times. A tap can be soft, hard, quick, slow, or repeated. In some implementations, the user can use an object to assist with tapping such as a pen, pencil, or other object configured to be used for tapping the hearing device 103. Although FIG. 1 only shows a user tapping one hearing device 103, a user can tap both hearing devices simultaneously or separately.

As shown by double-headed bold arrows in FIG. 1, the wireless communication devices 102 and the hearing devices 103 can communicate wirelessly, e.g., each wireless communication device 102 can communicate with each hearing device 103 and each hearing device 103 can communicate with the other hearing device. Wireless communication can include using a protocol such as Bluetooth BR/EDR™, Bluetooth Low Energy™, a proprietary communication (e.g., binaural communication protocol between hearing aids based on NFMI or bimodal communication protocol between hearing devices), ZigBee™, Wi-Fi™, or an Industry of Electrical and Electronic Engineers (IEEE) wireless communication standard.

The wireless communication devices 102 are computing devices that are configured to wirelessly communicate. Wireless communication includes wirelessly transmitting information, wirelessly receiving information, or both. The wireless communication devices 102 shown in FIG. 1 can include mobile computing devices (e.g., mobile phone), computers (e.g., desktop or laptop), televisions (TVs) or components in communication with television (e.g., TV streamer), a car audio system or circuitry within the car, tablet, remote control; an accessory electronic device, a wireless speaker, or watch.

A hearing device user can wear the hearing devices 103 and the hearing device provides audio to a hearing device user. For example, a hearing device user can wear single hearing device 103 or two hearing devices, where one hearing device 103 is on each ear. Some example hearing devices include hearing aids, headphones, earphones, assistive listening devices, or any combination thereof; and hearing devices include both prescription devices and non-prescription devices configured to be worn on or near a human head.

As an example of a hearing device, a hearing aid is a device that provides amplification, attenuation, or frequency modification of audio signals to compensate for hearing loss or difficulty; some example hearing aids include a Behind-the-Ear (BTE), Receiver-in-the-Canal (RIC), In-the-Ear (ITE), Completely-in-the-Canal (CIC), Invisible-in-the-Canal (IIC) hearing aids or a cochlear implant (where a cochlear implant includes a device part and an implant part).

The hearing devices 103 are configured to binaurally or bimodally communicate. The binaural communication can include a hearing device 103 transmitting information to or receiving information from another hearing device 103. Information can include volume control, signal processing information (e.g., noise reduction, wind canceling, directionality such as beam forming information), or compression information to modify sound fidelity or resolution. Binaural communication can be bidirectional (e.g., between hearing devices) or unidirectional (e.g., one hearing device receiving or streaming information from another hearing device). Bimodal communication is like binaural communication, but bimodal communication includes two devices of a different type, e.g. a cochlear device communicating with a hearing aid.

FIG. 1 also illustrates a fitting station 105. The fitting station 105 can fit the hearing devices 103 for a hearing device user and the fitting station 105 can be configured to communicate with the hearing devices 103 (e.g., via Bluetooth™ or another wireless communication protocol). The fitting station 105 can be a computer or a terminal connected to a server or cloud computing service via a network 107.

For example, the fitting station 105 can be a computer in a HCP's office (e.g., a home office), where the fitting station 105 is used to fit hearing devices.

The fitting station 105 can include fitting software. The fitting software is a set of instructions that can program or adjust the hearing devices 103. The fitting software can incorporate user experience values or user experience settings such as how a user feels or how a user perceived a sound (e.g., dog bark, conversation, high pitched noise) or a sound environment (e.g., movie theater, quite room). The fitting software can personalize settings to accommodate individual user preferences and listening needs.

Also, the fitting software can receive information from a hearing device's accelerometer. The fitting software can use this information to learn about a user's tapping parameters. The fitting software can detect magnitude of a user's tap or how the times a user waits between taps or a double tap. The fitting software can also provide a tap task for the user. For example, the fitting software can ask the user to tap in response to a request. Alternatively, the fitting software can simulate a hearing scenario where a user can implement tap control. For example, the fitting software can provide a sound environment that is too loud or too soft, and the user can tap to control the volume in response to the provided scenario. As another example, the fitting software can ask the hearing device user to tap a hearing device to stop music from playing. As further explained in FIGS. 2, 3A, 3B and 4, tapping information received by the fitting software can be used to provide customized or adapted tap detection parameters for tap control.

A hearing care professional 108 is a person who is helping someone fit a hearing device. A hearing care professional can be an audiologist, doctor, or technician. The hearing care professional 108 can interact with the hearing devices user, the fitting station 108, and the hearing devices 103. A hearing care professional is also referred to as an "HCP".

The network 107 is a communication network. The network 107 enables the hearing devices 103 or the wireless communication devices 102 to communicate with a network or other devices. The network 107 can be a Wi-Fi™ network, a wired network, or a network implementing any of the Institute of Electrical and Electronic Engineers (IEEE) 802.11 standards. The network 107 can be a single network, multiple networks, or multiple heterogeneous networks, such as one or more border networks, voice networks, broadband networks, service provider networks, Internet Service Provider (ISP) networks, and/or Public Switched Telephone Networks (PSTNs), interconnected via gateways operable to facilitate communications between and among the various networks. In some implementations, the network 107 can include communication networks such as a Global System for Mobile (GSM) mobile communications network, a code/time division multiple access (CDMA/TDMA) mobile communications network, a 3rd, 4th or 5th generation (3G/4G/5G) mobile communications network (e.g., General Packet Radio Service (GPRS)) or other communications network such as a Wireless Local Area Network (WLAN).

Figure 2:
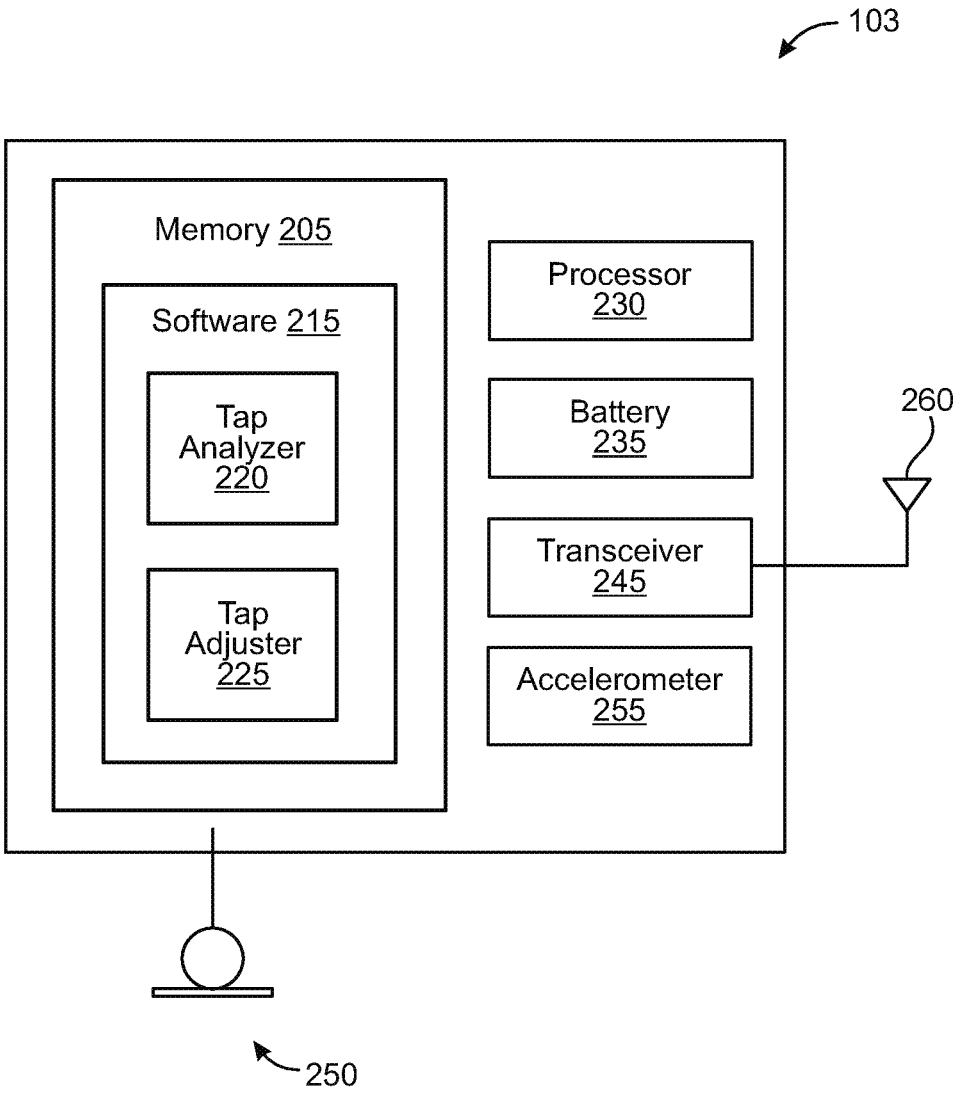
FIG. 2 illustrates a hearing device from FIG. 1 in more detail in accordance with some implementations of the disclosed technology.

FIG. 2 is a block diagram illustrating the hearing device 103 from FIG. 1 in more detail. FIG. 2 illustrates the hearing device 103 with a memory 205, software 215 stored in the memory 205, the software 215 includes a tap analyzer 220 and a tap adjuster 225. In FIG. 2, the hearing device 103 also has a processor 230, a battery 235, a transceiver 245 coupled to an antenna 260, and a microphone 250. Each of these components is described below in more detail.

The memory 205 stores instructions for executing the software 215 comprised of one or more modules and data utilized by the modules. The modules perform certain methods or functions for the hearing device 103 and can include components, subcomponents, or other logical entities that assist with or enable the performance of these methods or functions. Although a single memory 205 is shown in FIG. 2, the hearing device 103 can have multiple memories 205 that are partitioned or separated, where each memory can store different information.

The tap analyzer 220 can analyze tap data related to user tapping a device. Tap data can include acceleration associated with a tap, the slope of acceleration associated with a tap, time between a first and second tap, acceleration for a shock period after the tap (e.g., when the hearing aid is still vibrating or moving because of a tap), or acceleration in different directions associated with a tap (e.g., x, y, z, or other orthogonal axes for acceleration). The tap analyzer 220 can communicate with the accelerometer 255 to receive information from the accelerometer 255; the tap analyzer 220 can also communicate with other components of the hearing device 103 including the processor 230.

The tap adjuster 225 can adjust tap sensitivity for a hearing device based on adjusting or setting tap detection parameters. Tap detection parameters are used to determine whether a hearing device has received a tap. Tap detection parameters can be based on tap data and can include a slope of acceleration associated with a tap, time between a first and second tap, acceleration for a shock period after the tap (e.g., when the hearing aid is still vibration or moving because of a tap), or acceleration in different directions associated with a tap (e.g., x, y, z, or other orthogonal axes for acceleration). The tap adjuster 225 can adjust the tap detection parameters such that false positives are reduced, but also so that the probability of not detecting an actual tap or taps is reduced. In some implementations, to reduce false positives the hearing device can set a tap sensitivity parameter to be more restrictive, e.g., increase threshold on acceleration amplitude or slope magnitude, shorten allowed shock time, decrease slope magnitude thresholds which must not be exceeded during quiet time. To reduce false negatives, the hearing device set a parameter to be more forgiving, e.g., decrease a threshold on acceleration amplitude or slope magnitude, increase allowed shock time, or increase slope magnitude thresholds.

The processor 230 can include special-purpose hardware such as application specific integrated circuits (ASICs), programmable logic devices (PLDs), field-programmable gate arrays (FPGAs), programmable circuitry (e.g., one or more microprocessors microcontrollers), Digital Signal Processor (DSP), Neural network engines, appropriately programmed with software and/or computer code, or a combination of special purpose hardware and programmable circuitry.

Also, although the processor 230 is shown as a separate unit in FIG. 2, the processor 230 can be on a single chip with the transceiver 245, and the memory 205. The processor 230 can also include a DSP configured to modify audio signals based on hearing loss or hearing programs stored in the memory 205. In some implementations, the hearing device 103 can have multiple processors, where the multiple processors can be physically coupled to the hearing device 103 and configured to communicate with each other.

The battery 235 can be a rechargeable battery (e.g., lithium ion battery) or a non-rechargeable battery (e.g., Zinc-Air) and the battery 235 can provide electrical power to the hearing device 103 or its components. In general, the battery 235 has significantly less available capacity than a battery in a larger computing device (e.g., a factor 100 less than a mobile phone device and a factor 1000 less than a laptop).

The microphone 250 is configured to capture sound and provide an audio signal of the captured sound to the processor 230. The microphone 250 can also convert sound into audio signals. The processor 230 can modify the sound (e.g., in a DSP) and provide the processed audio derived from the modified sound to a user of the hearing device 103. Although a single microphone 250 is shown in FIG. 2, the hearing device 103 can have more than one microphone. For example, the hearing device 103 can have an inner microphone, which is positioned near or in an ear canal, and an outer microphone, which is positioned on the outside of an ear. As another example, the hearing device 103 can have two microphones, and the hearing device 103 can use both microphones to perform beam forming operations. In such an example, the processor 230 would include a DSP configured to perform beam forming operations.

The accelerometer 255 can be positioned inside the hearing device and detect acceleration changes of the hearing device. The accelerometer 255 can be a capacitive accelerometer, a piezoelectric accelerometer, or another type of accelerometer. In some implementations, the accelerometer can measure acceleration along only a single axis. In other implementations, the accelerometer can sense acceleration along two axes or three axes. For example, the accelerometer can create a 3D vector of acceleration in the form of orthogonal components. The accelerometer 255 can output a signal that is received by the processor 230 (e.g., including raw data). The acceleration can be output in meters/second or g's (1 g=9.81 meters/second$^2$). In some implementations, the accelerometer can detect acceleration changes from −2 g's to +2 g's or −16 g's to +16 g's sampled at a frequency of greater than 100 Hz, e.g., 200 Hz.

The accelerometer 255 can also be in a housing of the hearing device, where the housing is located behind a user's ear. Alternatively, the accelerometer 255 can be in a housing for a hearing device, wherein the housing is inside a user's ear canal or at least partially inside a user's ear. The accelerometer 255 can be an ultra-low power device, wherein the power consumption is less than 10 micro Amps (μA). The accelerometer 255 can be a micro-electro-mechanical system (MEMS) or nanoelectromechanical system (NEMS).

The antenna 260 can be configured for operation in unlicensed bands such as Industrial, Scientific, and Medical Band (ISM) using a frequency of 2.4 GHz. The antenna 260 can also be configured to operation in other frequency bands such as 5.8 GHz, 3.8 MHz, 10.6 MHz, or other unlicensed bands.

Although not shown in FIG. 2, the hearing device 103 can include additional components. For example, the hearing device can also include a transducer to output audio signals (e.g., a loudspeaker or a transducer for a cochlear device configured to convert audio signals into nerve stimulation or electrical signals). Further, although not shown in FIG. 2, the hearing device can include sensors a photoplethysmogram sensor or other sensors configured to detect health conditions regarding the user wearing the hearing device 103.

Also, the hearing device 103 can include an own voice detection unit configured to detect a voice of the hearing device user and separate such voice signals from other audio signals. To implement detecting own voice, the hearing device can include a second microphone configured to convert sound into audio signals, wherein the second microphone is configured to receive sound from an interior of an ear canal and positioned within the ear canal, wherein a first microphone is configured to receive sound from an exterior of the ear canal. The hearing device can also detect own voice of a hearing device user based on other implementations (e.g., a digital signal processing algorithm that detects a user's own voice).

Figure 3A:
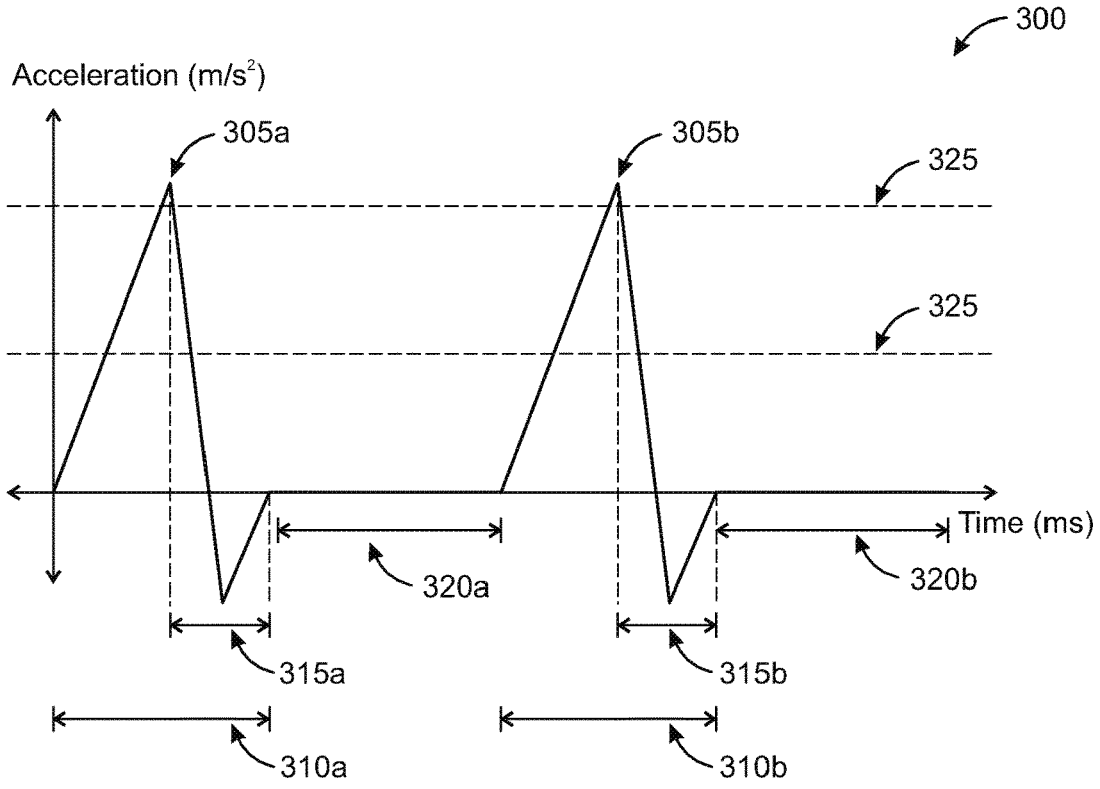
FIGS. 3A and 3B are graphs illustrating detected acceleration in response to tapping a hearing device in accordance with some implementations of the disclosed technology.

FIG. 3A is a graph 300 illustrating detected acceleration in response to tapping a hearing device. On the y-axis is measured acceleration (in units of m/s$^2$) and on the x-axis is time (e.g., in milliseconds (ms)). The graph 300 shows two taps, a first tap followed by a second tap. The first tap (left side) has a peak in acceleration at 305*a* and the second tap (middle right) has a peak in acceleration at 305*b*. The first tap has measurable acceleration effects that last for a duration period 310*a* and the second tap has measurable effects that last for duration period 310*b*. After the peak, there is a shock period 315*a* (first tap) and 315*b* (second tap) that relates to the acceleration of the hearing device in response to the tap. Additionally shown, there is a quiet period 320*a* between the first tap and the second tap, which refers to when little to no changes in acceleration are detected. Depending on a person's double tapping pattern, the quiet period 320*a* (or quiet period 320*b* after the second tap) can vary.

Figure 3B:
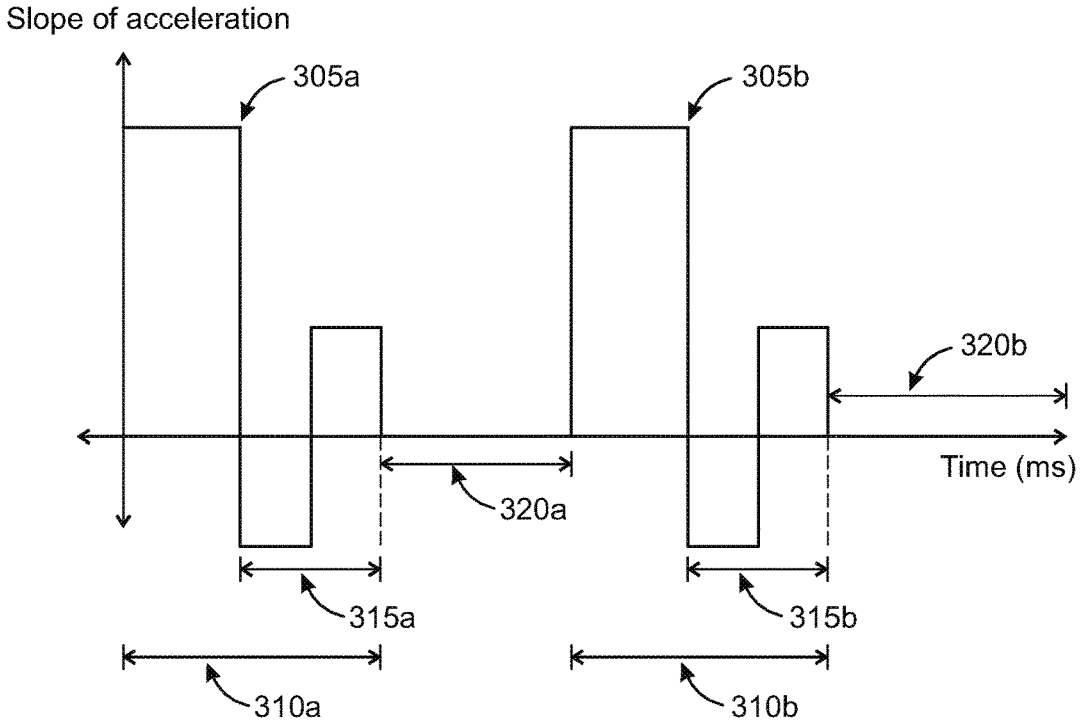

FIG. 3B is a graph 350 illustrating the slope (first derivative) of the measured acceleration of the hearing device versus time (ms). The graph is for illustrative purposes and likely varies slightly based on actual conditions of the hearing device, e.g., type of accelerometer, position of accelerometer, or composition and weight of the hearing device. As shown in FIG. 3B, the graph has a positive slope until peak 305*a* and then it has a negative slope, which indicates acceleration in the opposite direction. During the quiet period 320*a*, there is no change in acceleration detected. Although slope is illustrated in FIG. 3B, in some implementations, the disclosed technology can calculate a "slope magnitude", which is generally the absolute value of the slope (mathematically it is sqrt(slope_x^2+slope_y^2+slope_z^2), where x, y, and z refer to different orthogonal directions).

The slope of acceleration, as tap detection parameter, can be used to adjust the sensitivity associated with detecting a tap. For example, the hearing device may only register a tap if the slope of acceleration is above a slope threshold (e.g., slope of 5). The hearing device can also adjust this slope threshold based on tap tasks given to the user that train the hearing device to learn the preferences of the hearing device user. For example, if the hearing device determines that the user has a relatively soft tap and it wants tap detection parameters to be more sensitive to detecting a tap, it can set the slope threshold to be low (e.g., 3 or less); and if the hearing device wants less sensitivity it can set the slope threshold high (e.g., 3 or more).

Figure 4:
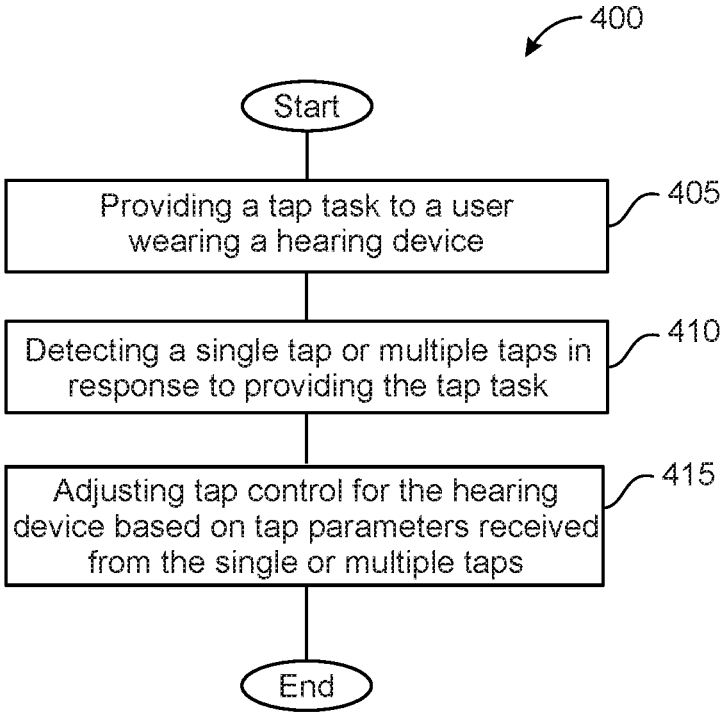
FIG. 4 is a block flow diagram illustrating a process for learning tap parameters for a hearing device in accordance with some implementations of the disclosed technology.

Using the tap parameters discussed in FIGS. 3A and 3B, the hearing device can sense and learn tap parameters for a hearing device user. For example, the hearing device can learn that a user taps harder on his left side than on his right side; accordingly, the hearing device can adjust the tap parameters to be more sensitive to these user preferences. The hearing device can determine that has a stronger than average tap (e.g., based on slope of acceleration). Then, the hearing device can set a threshold for this specific user higher so that the number of false positives are reduced. Also, the hearing device can determine that average time between double taps for a user FIG. 4 illustrates a block flow diagram for a process 400 for learning tapping parameters for a hearing device. The hearing device 103, the fitting station 105, or another computing device can perform part or all the process 400. The process 400 can begin providing a tap task operation 405 and continue to detect tap operation 410.

At provide tap task operation 405, a fitting station, a mobile device, or a hearing device can provide a tap task to a hearing device user. The tap task can request that a hearing device user perform a single tap, multiple taps, or taps on a specific hearing device (e.g., left or right). The tap task can also be based on a scenario (e.g., simulated, or actual). For example, the tap task can be associated with a user moving (e.g., walking, running), in response to a phone call, or in a loud or soft sound environment.

The fitting station, the mobile device, or the hearing device can repeatedly provide the tap task to the user or provide variations of the tap task to learn about the user's tapping tendencies. For example, the fitting station may ask the user to repeat taps for a time period (30 seconds) to determine the average tap strength of the user. Alternatively, the fitting station may provide different scenarios to hearing device user and continuously measure how the user taps in these scenarios. In response to providing the tap tasks, the fitting station or mobile device can instruct the hearing device to continue varying tap detection parameters until the hearing device user or HCP is satisfied with the result. For example, after the user can performed a tap task, the fitting station or mobile device can ask the user if all the taps were accurately recorded or if any taps were not detected. Based on this feedback, the hearing device can continuously learn and adapt its tap detection parameters to optimize false positives and missed tap detections.

In some implementations, the process 400 starts only after it is determined that the user is wearing the hearing device. To determine whether a user is wearing a hearing device, the process 400 can integrate the process described U.S. patent application Ser. No. 16/367,328, titled "Context Dependent Tapping for Hearing Devices."

At detect tapping operation 410, the hearing device detects a single or multiple taps in response to the tap task. The hearing device can detect single or multiple taps based on its accelerometer or its processor. The accelerometer can use metric units (m/s2) or units of gravitational constant "g," where 1 g=9.81 m/s2. The detection tapping operation 410 can include receiving tap data. Tap data can include acceleration associated with a tap, the slope of acceleration associated with a tap, time between a first and second tap, acceleration for a shock period after the tap (e.g., when the hearing aid is still vibrating or moving because of a tap), or acceleration in different directions associated with a tap (e.g., x, y, z, or other orthogonal axes for acceleration).

At adjusting tap operation 415, the hearing device adjusts tap detection parameters for the hearing devices based on tap parameters received from the single or multiple taps in operation 410. The hearing device can adjust the tap detection parameters such that the hearing device is optimized to detect a single tap or multiple taps based on tendencies of the hearing device user. The tendencies are related to the tap parameters of the hearing device user, e.g., how softly he or she taps, when she or he taps (e.g., based on scenarios), time between taps, or based on the user's preference of left side or right-side tapping. For example, the hearing device can set a high or low acceleration detection threshold for adjusting a volume control based whether the user taps softly or strongly.

Although not included in the process 400, in response to detecting a tap based on the adjusted parameters, the hearing device can modify the hearing device or performs and operation. The hearing device can modify the hearing device to change a parameter based on the detected tap or taps. The hearing device can change the hearing profile, the volume, the mode of the hearing device, or another parameter of the hearing device. For example, the hearing device can increase or decrease the volume of a hearing device based on the detected tap. Additionally, the hearing device can perform an operation in response to a tap. For example, if the hearing device receives a request to answer a phone and it detected a single tap (indicating the phone call should be answered), the hearing device can transmit a message to a mobile phone communicating with the hearing device to answer the phone call. Alternatively, the hearing device can transmit a message to the mobile phone to reject the phone call based on receiving a double tap.

The process 400 can be repeated entirely, repeated partially (e.g., repeat only operation 405), or stopped after operation 425. For example, the hearing device user or the HCP can determine that the tap control task training is done, and the hearing device is properly detecting taps, so the process 400 can be stopped. Alternatively, the fitting station, HCP, or a mobile device can ask a hearing device user if he or she is satisfied with the tap detection based on the adjusted tap detection parameters. If the user responds that he or she is not satisfied (e.g., via a graphical user interface or a survey), the process 400 can be repeated partially or entirely. Also, in some implementations, the process 400 can be repeated until the hearing device user responds that he or she is satisfied or the process 400 can also include alerting the HCP that the user is still not satisfied with tap control. Based on this feedback, the HCP can perform further operations on the hearing device or deactivate tap control.

The phrases "in some implementations," "according to some implementations," "in the implementations shown," "in other implementations," and generally mean a feature, structure, or characteristic following the phrase is included in at least one implementation of the disclosure, and may be included in more than one implementation. In addition, such phrases do not necessarily refer to the same implementations or different implementations.

The techniques introduced here can be embodied as special-purpose hardware (e.g., circuitry of a hearing device), as programmable circuitry appropriately programmed with software or firmware, or as a combination of special-purpose and programmable circuitry. Hence, implementations may include a machine-readable medium having stored thereon instructions which may be used to program a computer (or other electronic devices) to perform a process. The machine-readable medium may include, but is not limited to, read-only memory (ROM), random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is non-transitory computer readable medium, where in non-transitory excludes a propagating signal.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. For example, while processes or blocks are presented in an order, alternative implementations may perform routines having steps, or employ systems having blocks, in a different order, and some processes or blocks may be deleted, moved, added, subdivided, combined, or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc. As another example, "A or B" can be only A, only B, or A and B.

We claim:

1. A method for tap control adjusting of a hearing device, the method comprising:

providing a tap task to a hearing device user;

receiving a single tap or multiple taps in response to providing the tap task to the hearing device user;

determining a tap parameter associated with the single or multiple taps, wherein the tap parameter is a magnitude of a slope of acceleration of a tap, wherein the magnitude of the slope of the acceleration of the tap is based on $\sqrt{x^2+y^2+z^2}$, wherein x is associated with slope of acceleration in the x direction, y is slope of associated with acceleration in the y-direction, and z is associated with slope of acceleration in the z-direction;

providing a tap detection parameter for the hearing device based on the determined tap parameter, wherein the tap detection parameter is used to adjust detection of a hearing device user tapping gesture;

providing a second tap task to the user, wherein the second tap task is the same as the first tap task;

detecting another single tap or other multiple taps in response to providing the second tap task; and updating the tap detection parameter based on the second tap task.

2. The method of claim 1, the method further comprises:

providing a survey to user prior to, during, or after the tap task, and wherein determining the tap parameter further comprises determining the tap parameter based also on answers associated with the survey.

3. The method of claim 1, wherein the method further comprises:

transmitting, by a fitting station, a request to detect tapping at the hearing device.

4. The method of claim 1, wherein the method further comprises:

transmitting, by a mobile application, a request to detect tapping at the hearing device.

5. The method of claim 1, wherein the method further comprises:

determining the hearing device user wears glasses; and adjusting the provided tap detection parameter based on the determining that the hearing device user wears glasses.

6. The method of 5, wherein determining the user wears glasses further comprises:

receiving a response to a questionnaire; or detecting an acceleration pattern that indicates the hearing device user is wearing glasses based on the single tap or multiple taps.

7. The method of claim 1, wherein the method further comprises:

transmitting, by a mobile device, a request to detect tapping at the hearing device.

8. The method of claim 1, wherein the method further comprises:

associating the tap detection parameters with a hearing device profile or hearing device setting.

9. A hearing device, the hearing device comprising:

a microphone configured to receive sound and convert the sound into audio signals;

an accelerometer configured to detect a change in acceleration of the hearing device;

a processor configured to receive the audio signals from the microphone and receive information from the accelerometer;

a memory, electronically coupled to the processor, the memory storing instructions that cause the hearing device to perform operations, the operations comprising:

receive a single tap or multiple taps in response to a tap task to the hearing device user;

determine a tap parameter associated with the single or multiple taps, wherein the tap parameter is a magnitude of a slope of acceleration of a tap wherein the magnitude of the slope of acceleration of the tap is based on $\sqrt{x^2+y^2+z^2}$, wherein x is associated with acceleration in the x direction, y is associated with acceleration in the y-direction, and z is associated with acceleration in the z-direction;

provide a tap detection parameter for the hearing device based on the determined tap parameter;

provide a second tap task to the user, wherein the second tap task is the same as the first tap task;

detect another single tap or other multiple taps in response to providing the second tap task; and update the tap detection parameter based on the second tap task.

10. The hearing device of claim 9, the operations further comprising:

adjust a tapping period based on determining that a quiet period or shock period time has expired before detecting the second tap.

11. The hearing device of claim 9, wherein the tap task further includes: request that the hearing device user provide a first tap and a second tap, wherein the request indicates the first tap should be stronger than the second tap.

12. The hearing device of claim 11, wherein the operations further comprise:

determine a difference between the tap parameters for the first tap and the second tap; and store the difference in a memory of the hearing device.

13. A non-transitory computer-readable medium storing instructions that when executed by a processor cause a hearing device to perform operations, the operations comprising:

provide a tap task to a hearing device user;

receive a single tap or multiple taps in response to providing the tap task to the hearing device user;

determine a tap parameter associated with the single or multiple taps, wherein the tap parameter is a magnitude slope of acceleration of a tap wherein the magnitude of the slope of acceleration of the tap is based on $\sqrt{x^2+y^2+z^2}$, wherein x is associated with acceleration in the x direction, y is associated with acceleration in the y-direction, and z is associated with acceleration in the z-direction;

provide tap detection parameter for the hearing device based on the determined tap parameter;

provide a second tap task to the user, wherein the second tap task is the same as the first tap task;

detect another single tap or other multiple taps in response to the second tap task;

update the tap detection parameter based on the second tap task; and provide an updated detection parameter for the hearing device.

14. The non-transitory computer readable medium of claim 13, wherein in the tap task is associated with a request from a mobile device, fitting station, or in response to a mobile device program request.

15. The non-transitory computer readable medium of claim 13, the operations further comprise:

provide a survey to user prior to, during, or after the tap task, and wherein determining the tap parameter further comprises determining the tap parameter based also on answers associated with the survey.

* * * * *